US011246424B2

(12) United States Patent
Kamal El Din

(10) Patent No.: US 11,246,424 B2
(45) Date of Patent: Feb. 15, 2022

(54) FLEXIBLE FOLDABLE FURNITURE BY USING HONEYCOMB TECHNOLOGY

(71) Applicant: Elephant in a Box, Inc., New York, NY (US)

(72) Inventor: Mohamed El Sayed Ahmed Kamal El Din, New York, NY (US)

(73) Assignee: ELEPHANT IN A BOX, INC., New York, NY (US)

( * ) Notice: Subject to any disclaimer, the term of this patent is extended or adjusted under 35 U.S.C. 154(b) by 0 days.

(21) Appl. No.: 17/049,659

(22) PCT Filed: Apr. 17, 2019

(86) PCT No.: PCT/EG2019/000010
§ 371 (c)(1),
(2) Date: Oct. 22, 2020

(87) PCT Pub. No.: WO2019/206390
PCT Pub. Date: Oct. 31, 2019

(65) Prior Publication Data

US 2021/0235879 A1 Aug. 5, 2021

Related U.S. Application Data

(60) Provisional application No. 62/661,484, filed on Apr. 23, 2018.

(51) Int. Cl.
*A47C 19/04* (2006.01)
*A47C 19/02* (2006.01)
*A47C 31/00* (2006.01)

(52) U.S. Cl.
CPC ..... *A47C 19/04* (2013.01); *A47C 19/021* (2013.01); *A47C 31/001* (2013.01)

(58) Field of Classification Search
CPC ..... A47C 19/00; A47C 19/04; A47C 19/021; A47C 19/022
See application file for complete search history.

(56) References Cited

U.S. PATENT DOCUMENTS 2,587,302 A 2/1952 Fawcett
3,866,550 A 2/1975 Geschwender
(Continued)

FOREIGN PATENT DOCUMENTS

CN 2250136 Y 3/1997
CN 201115537 Y 9/2008
(Continued)

OTHER PUBLICATIONS

ISA/US, PCT International Search Report and Written Opinion and PCT International Preliminary Report on Patentability issued in PCT International Application No. PCT/EG2019/000010 dated Apr. 1, 2020.

*Primary Examiner* — Fredrick C Conley
(74) *Attorney, Agent, or Firm* — Gottlieb, Rackman & Reisman, P.C.

(57) ABSTRACT

The present invention relates to an improved furniture system, particularly a sofa and a bed, which is reduced to a minimum volume for transportation. The minimum volume is created to meet the current requirements for e-commerce. A flexible foldable honeycomb structure is used in manufacturing a supporting structure for a seat and a bed frame, wherein the hexagonal shape of said structure is strong and stable and provides a high bearing capacity versus weight. The honeycomb structure is designed to be foldable and used for saving space and to be easier for delivery in a box that fits in a small car, wherein said structure used flaccid materials that are glued to each other in certain way to open and close easily, wherein the number of layers of the flaccid
(Continued)

Top View Expanded Bed

Cross section A-A Side View Expanded Bed materials determines the expansion length of the structure and these layers together is called a block of honeycomb.

20 Claims, 5 Drawing Sheets

(56) References Cited

U.S. PATENT DOCUMENTS

| | | | | |
|---|---|---|---|---|
| 4,824,411 | A | 4/1989 | McClanahan | |
| 4,881,779 | A | 11/1989 | Bubien | |
| 6,253,530 | B1 | 7/2001 | Price et al. | |
| 6,372,322 | B1 | 4/2002 | Devaguptapu | |
| 6,401,282 | B1 * | 6/2002 | Shum | A47C 23/002 5/701 |
| 6,800,351 | B1 | 10/2004 | Pflug et al. | |
| 2005/0278860 | A1 | 12/2005 | Landi et al. | |
| 2008/0237319 | A1 | 10/2008 | Hensey et al. | |
| 2009/0078838 | A1 | 3/2009 | Chang | |
| 2010/0019630 | A1 | 1/2010 | Leng | |
| 2016/0058203 | A1 * | 3/2016 | Yaacoby | A47D 15/003 5/722 |
| 2016/0183674 | A1 | 6/2016 | Lee | |

FOREIGN PATENT DOCUMENTS

| | | | |
|---|---|---|---|
| CN | 104720421 | A | 6/2015 |
| CN | 206659510 | U | 11/2017 |
| WO | 2011/058348 | A1 | 5/2011 |
| WO | 2017/000607 | A1 | 1/2017 |
| WO | 2017/005363 | A1 | 1/2017 |
| WO | 2019/206390 | A2 | 10/2019 |

* cited by examiner

Cross section A-A Side View Expanded Bed

Expanded Side View Expanded Bed

Top View folded Bed

Side View folded Bed

Honeycomb foldable Sofa Structure

Top View Expanded Sofa

Top View folded Sofa

Cross section A-A Side View

Side View folded sofa

Expanded front View

7- Armrest
8- Flexible hexagonal Honeycomb Structure
9- Arm rest
10- Expansion struts
11- Front Padding

FLEXIBLE FOLDABLE FURNITURE BY USING HONEYCOMB TECHNOLOGY

The present application is a national phase filing of PCT EG/2019/000010, filed Apr. 17, 2019, which claims priority to U.S. Provisional Patent Application No. 62/661,484, filed Apr. 23, 2018, both of which are incorporated by reference.

FIELD OF THE INVENTION

The present invention is related to flexible foldable furniture components and their advantages in both transportation and installation by using honeycomb technology

BACKGROUND ART

The honeycomb structure is used to provide flexibility of the structure to open and close, which provide great reduction in volume and weight. The hexagonal shape of the structure proved to be a very strong and stable giving high bearing capacity versus weight. Honeycomb structure is a structure of flaccid materials that are glued to each other in certain way that makes them open and close easily. The glue lines width and the distance between the glue lines affect the flexibility of the structure. The number of layers of the flaccid materials determines the expansion length of the structure. The glued layers can be any number depending on the design needed. These layers together are called a block of honeycomb. By cutting the above-mentioned block into certain shapes, we can provide different shapes. It can be cut into shape of a seat or a bed. By providing the supporting boards, armrest, foam, fiber, and accessories, the final product can be a complete seat or a bed.

According to the seating, the honeycomb structure is the main supporting structure for the seat. It has a high bearing capacity when it is unfolded (expanded). In the current system, the weight of the honeycomb structure for the sofa is about 10 Kg using flaccid material like paper, plastic or others. The structure them, is connected to boards on both sides. These boards can be made out of wood or other materials. The structure is then expanded and held in place using extension rods or pieces that can be out of wood or any other material. The extension of the structure can start from 6 to 1000 meter depending on the number of layers in the honeycomb. Typically, the seating can be extended 40 to 400 cm. The rods linearly hold the structure in place by connectors that can be steel, plastic or any other material. Armrests are connected directly to the seat's honeycomb structure. The connection could be by applying glue or by providing connectors to the armrest to connect them to the seat's honeycomb structure. The weight of the armrest can be from 2 kg to 40 kg each depending on the materials used. After extending the structure, a padding can be provided to protect the structure against damage. Upon the structure, with or without the padding, sponge may be used to provide cushioning.

The structure of the current invention can be used to make a bed frame or sofa. The quality of a portable foldable bed or seat is measured according to the below four main criteria:

The weight of the seat.

The volume of the seat when it is folded.

The time required to fold/unfold the seat.

The bearing capacity of the seat.

The time of assembly and disassembly.

In the current systems, the weight of the foldable seat is about 11 kg of honeycomb paper (The two side boards are not included).

The volume of the seat when it is folded (60-110 cm length×40-90 cm width×Thickness 3-10 cm) without the armrest.

The time required to fold/unfold the seat (1-2 minutes).

The bearing capacity of the seat is at least 40 ton/m2).

The whole seat can be provided folded in one or more carton boxes. The structure can be either a seat, love seat or a sofa for three people or more. When this seat is made to be a sofa for three people, the foldable volume of the sofa is at least 50% less than the fixed sofas/flat pack sofas in the market. The weight of the sofa is at least 50% less than the counterpart sofas in the market.

The structure of the current invention can be used to make a bed frame. The quality of a portable foldable bed is also measured according to the below four main criteria:

The weight of the bed.

The volume of the bed when it is folded.

The time required to fold/unfold the bed.

The bearing capacity of the bed.

In current systems, the weight of the foldable bed: 8.5 kg of honeycomb paper (The two head boards are not included).

The volume of the bed when it is folded (80×40×11 cm)

The time required to fold/unfold the bed is less than 5 minutes.

The bearing capacity of the bed (at least 2 ton/m2).

The weight of a foldable bed of 80×200 cm is less than 15 kg depending on the hexagonal cell size and number of layers. The bearing capacity of the extended structure can carry a weight of more than 1000 kg on a surface of 80×200 cm. The more layers we add in the same area, the more bearing capacity it will carry.

The bed of the current invention is more than 25% lighter than any foldable bed frame. It is dressable where the covers of the two head and back boards can be changed easily and covered by the customer. The volume of the folded bed is half the volume any foldable bed in the market. The bed is made out of cellulose fiber sheets that are made from recyclable materials. This makes the bed fully green and environmentally friendly. The whole bed can be recycled again in a closed loop.

The weight and the dimensions of the current bed can make it shipped easily by air freight couriers. The shipping of the bed is at least 25% lower CO2 footprint than other normal beds in the market.

The flexibility of the honeycomb technology in the bed makes it versatile and multi-functions. It can be used as a side table, an ottoman, or a seat.

The fast operation of expanding and folding the bed makes the user experience more efficient and hence more convenient than other foldable beds in the market.

SUMMARY OF THE INVENTION

The present invention aims to overcome to the difficulty of transportation and installation plus the convenience in buying, moving in and moving out big pieces of furniture like a bed frame or a sofa.

The structure of the current invention can be used to make a flexible foldable bed frame, and the components of the bed comprising:

A—Head Board (1):

Head board (1) can be changeable and dressable as well. The dimensions and materials of the head board (1) can be changed to any size based on the bed size. Meanwhile, the side boards can be dressable where the cover can be replaced by any covering materials like fabric, leather, felt or any soft or rigid materials for aesthetics reason.

B—Flexible hexagonal Structure (2):

The cell structure is hexagonal that can be uniform or non-uniform. The non-uniform structure gives higher extension and makes easier to open and fold. The length of one side of the hexagonal cell can vary from 1 mm to 150 mm. The width of glue line can be anything from 1 mm to 50 mm.

C—End Board (3):

The two sides of the core are glued to a rigid or non-rigid materials. The rigid materials can be any type of wood boards, steel, aluminum or any other rigid materials. The non-rigid boards can be made out of non-woven materials like felt, foam, or any other soft material.

D—Side Boards (4):

The side boards can be rigid or soft boards. The board can be one piece or divided into two or more pieces for foldability reason. The side boards can be changeable to give different shape or color. Meanwhile, the side boards can be dressable where the cover can be replaced by any covering materials like fabric, leather, felt or any soft or rigid materials for aesthetics reason.

The structure of the current invention can also be used to make a flexible foldable sofa, and the components of the sofa comprising:

A—Flexible hexagonal Structure (5):

The honeycomb cell structure (1) is hexagonal that can be uniform or non-uniform. The non-uniform structure gives a higher extension and makes it easier to open and fold. The length of one side of one hexagonal cell can vary from 1 mm to 150 mm. The width of a glue line can be anything from 1 mm to 50 mm. The structure takes the shape of the seat and it can be extended from 6 to more than 1000 cm. For typical seating it can range from 20-300 cm.

B—Side board (6): The side board (6) a board connected to the honeycomb structure. The side boards can be rigid or soft boards. They are used to give support to the honeycomb structure and to have the connectors on. These connectors are used to connect the honeycomb structure, when expanded, to the extension rods linearly.

C—Extension Rods (7):

The extension rods (7) are responsible for extending the honeycomb structure and fix them in place. Any number from 1 or more can be used for extending the structure. Typically we use 2 or 4 extension rods. The material of the extension rod could be wood, steel, aluminum or any rigid material. They are connected to the seat honeycomb structure through the connectors. The length of the rods determines the length of the seat. They can vary from 30 to 400 cm depending on the length required of the seat. The extension rods can be elongated to give variable lengths. The rods can be divided into smaller pieces connected together to give flexible lengths. The extension rods are removable which gives the flexibility to the structure to fold back to its original dimension.

D—Armrest (8):

The armrests can be either separated or connected to the seat's honeycomb structure. The armrest can be made out of steel, wood, aluminum or any rigid structure. The armrest can be of any shape and dimensions. The armrest can be padded and/or covered by fabric. The armrest can be also made out foldable honeycomb that can be extended and covered by pieces of hard material like MDF sheets, plywood or others.

E—Padding (9):

Padding is a sheet of rigid or soft material that can be laid over the honeycomb structure to give fixation, and protection. It is made out of rigid sheet that can be padded by foam and/or fiber. The padding can be covered by fabric or any rigid/soft material.

DETAILED DESCRIPTION OF A PREFERRED EMBODIMENT

The aim of the invention is to provide foldable furniture using honeycomb technology. Moving/shipping furniture like seats and bed frames is a pain due to its huge volume. Moving a big piece of furniture requires big spaces in shipping containers, big spaces in trucks and labors to carry them to the final places. Beside the high shipping cost per piece, the CO2 footprint of transporting the big pieces of furniture is high which adds to bot: the carbon dioxide emissions and ultimately to the climate change in terms of global warming. The honeycomb technology is a structure used in manufacturing aero planes body is now used for furniture. The foldability aspect of such technology would allow to reduce the volume, weight and the cost of the product considerably which may lead to a complete disruption in the furniture industry. The present invention relates to a flexible foldable bed made of a core of layers of paper. The core shape can be opened and closed manually. The structure is made of honeycomb technology where the layers are glues together with glue. The structure of hexagonal shape is rigid and can carry heavy weights. The bed portable and can be carried by one person. The bed is light in weight and is extendable to any length depending on the number of layers. The foldable bed uses extension bars to fix the structure in place using special connections.

The current glue is starch with acrylic additives. The glue that can be used is starch or any other glue like PVA, resins, acrylic or any other glue. The glue can be water based or solvent based.

The materials used in this structure is preferably Paper but can be any flaccid materials like, but not limited to, plastic, Non-woven fabric, or synthetic paper. The paper used can be either treated to be water resistant and/or fire retardant. The thickness of paper can vary from 10 micron to 15 mm. Other materials can be used to give the hexagonal shapes. Plastic, felt, non-woven fabric can be also used. Any flaccid materials can be used to give the same function.

For Paper, paper grams can vary from 40 to 500 gram per meter square. It also can be engineered to have better edge burst strength of 10-100.

The used paper can be treated and sprayed by coloring materials, i.e. pigments, or dyed in coloring chemicals. Spraying materials can be anything from coloring or adding feature and/or function to the structure like being water proof, or/and fire retardant, changing flexibility, changing color, or changing physical or chemical properties of the paper or other structural material.

The honeycomb foldable bed Structure of the present invention comprising the below components:

A—Headboard (1). B—Flexible hexagonal Structure (2). C—End board (3). D—Side Boards (4).

The advantage of these embodiments is that the structure can be divided into zones where the cell size can be reduced to give more support to the points of stresses of a sleeping person. The cell size can be larger in the areas that will not carry more load.

The structure is also so flexible due to the improvement done on the cell size and glue size. The cell side is determined by the space between the glue lines in the honeycomb core machine. The width of the glue line is also a factor in giving flexibility of the honeycomb structure. The improvement was done on the machine to increase the length between the glue lines from 2-3 cm to 7-10 cm. The glue width also was decreased from 10 mm to 2 mm. The glue width can go down to 1 mm. The smaller the glue line and the bigger width between the glue lines give higher flexibility.

There are two kinds of foldability for the bed of the current invention as below:

Horizontal foldability: The bed can be folded to be 2 cm and extended to be anything from 2 cm up to 10000 cm depending on the number of layers glued to each other.

Vertical foldability: The bed itself can be cut into two or more pieces then get attached to each other vertically with a hinge or any other connector. This allows the structure to be folded into two halves or more.

Characterized in that:

The honeycomb structure bed can be folded down to be 30×30×30 cm. The box which is used for the folded bed can be any size can have any side length from 20 to 300 cm. The box dimensions are variable to accommodate the required size of the mattresses.

The components of the sofa comprising:

A—Flexible hexagonal Structure (5). B—Side board (6). C—Extension rods (7). D—Armrest (8). E—Padding (9).

It is worth mentioning that honeycomb structures are natural or man-made structures that have the geometry of a honeycomb to allow the minimization of the amount of used material to reach minimal weight and minimal material cost. The geometry of honeycomb structures can vary widely but the common feature of all such structures is an array of hollow cells formed between thin vertical walls. The cells are often columnar and hexagonal in shape. A honeycomb shaped structure provides a material with minimal density and relative high out-of-plane compression properties and out-of-plane shear properties.

The using of the honeycomb technology in the current invention, utilizes the gluing machines to glue the paper (or any flexible materials) in parallel glue lines, in which the lines are laid down ready for the next paper sheet. The glue is done in a staggered way paper after another. The whole stacked paper layers constitute a block of paper layers. The staggered way of gluing gives us the hexagonal shape constituting the honeycomb structure. Then, these layers are cut to the size of the bed by any cutting method. The cut block is attached to the headboard and the end board by glue or any hardware fixtures. The hexagonal shape has the property of being expanded manually to the size needed. The length of the expanded honeycomb depends on the number of paper layers. The design of the hexagonal structure, the distance between the glue lines and the width of the glue lines makes it easier to for the user to expand the bed. Then, the side boards are inserted to keep the structure in place and to the designed length ready for the mattress.

The constructive and functional characteristics of the foldable and transportable bed will be better understood from the following detailed description, in which reference is made to the accompanying drawings that illustrate a preferred and non-limiting embodiment and in which:

FIG. 1 shows the top view of the expanded bed, wherein the claimed bed comprising Headboard (1), Flexible hexagonal Structure (2), End Board (3) and Side Board (4) as shown in FIG. 1.

FIG. 2 shows the Cross section A-A Side view of the expanded bed, wherein it shows Headboard (1), Flexible hexagonal Structure (2), End Board (3).

FIG. 3 shows the Expanded Side View of the expanded bed, wherein it shows Headboard (1), End Board (3) and Side Board (4)

FIGS. 4 and 5 show the top and side view of the folded bed, wherein it shows Headboard (1), Flexible hexagonal Structure (2), End Board (3).

FIG. 6 Shows the top view of the expanded sofa, wherein the claimed sofa comprising Flexible hexagonal Structure (5), Side board (6), Extension rods (7), Armrest (8) and Padding (9).

FIG. 7 shows a particular embodiment of the Top View of a folded Sofa in order to clarify Flexible hexagonal Structure (5), Side board (6), Extension rods (7).

FIG. 8 shows a particular embodiment of the foldable sofa a cross section A-A Side View in order to clarify Flexible hexagonal Structure (5), Side board (6), Extension rods (7).

FIG. 9 shows a particular embodiment of the Side View of a folded sofa in order to clarify Flexible hexagonal Structure (5), Side board (6) and Armrest (8).

FIG. 10 shows a particular embodiment of the expanded front view of the foldable sofa to clarify Flexible hexagonal Structure (5), Side board (6), Extension rods (7), and Padding (9).

BRIEF DESCRIPTION OF THE DRAWINGS

An embodiment of the invention will now be described by way of example only and with reference to the accompanying drawings, in which.

Figure 1:
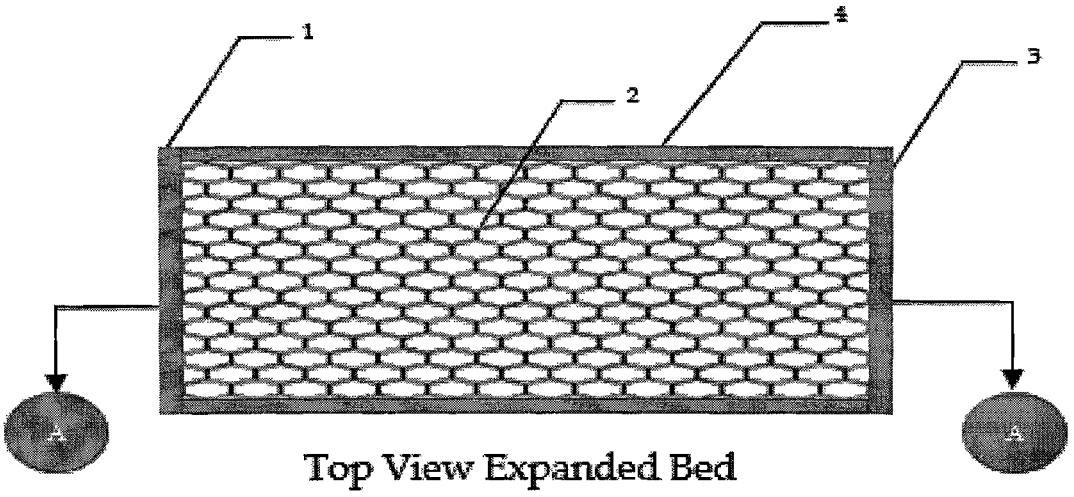
FIG. 1 shows a particular embodiment of the top view of the expanded bed to which the present invention relates.
Figure 2:
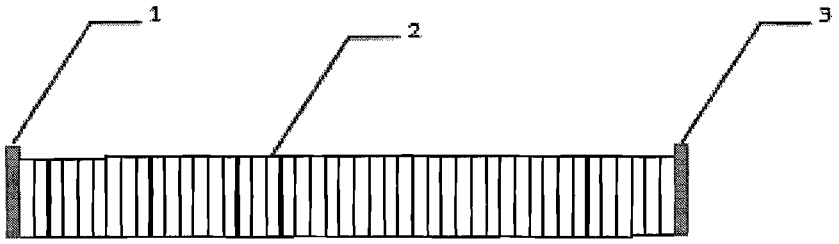
FIG. 2 shows a particular embodiment of the Cross section A-A Side view of the expanded bed to which the present invention relates.
Figure 3:
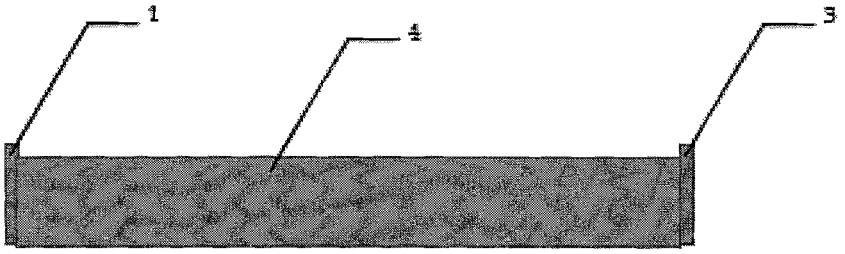
FIG. 3 shows a particular embodiment of the Expanded Side View of the expanded bed to which the present invention relates.
Figure 4:
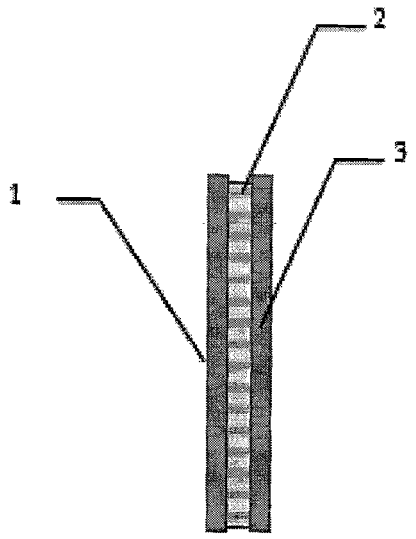
FIGS. 4 and 5 show a particular embodiment of the top and side view of the folded bed to which the present invention relates.
Figure 5:
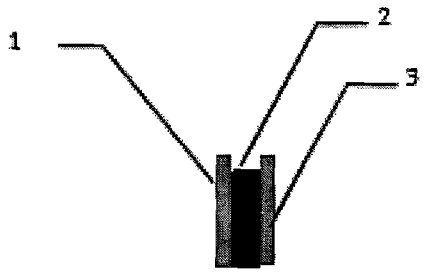
Figure 6:
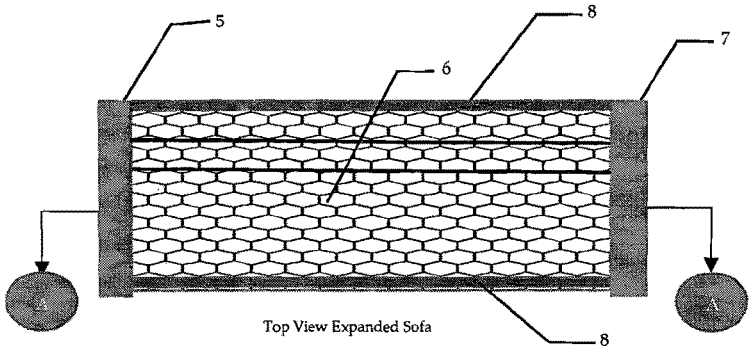
FIG. 6 shows a particular embodiment of the top view of the expanded sofa to which the invention relates.
Figure 7:
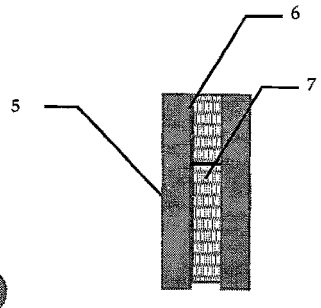
FIG. 7 shows a particular embodiment of the Top View of a folded Sofa to which the invention relates.
Figure 8:
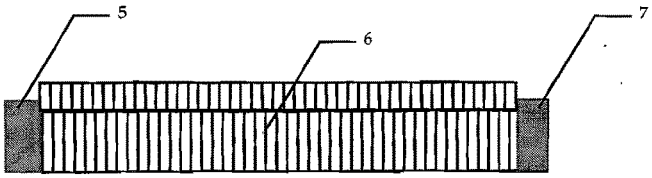
FIG. 8 shows a particular embodiment of the foldable sofa a cross section A-A Side View to which the invention relates.
Figure 9:
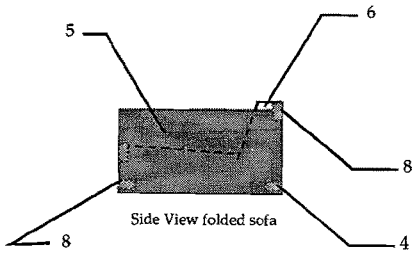
FIG. 9 shows a particular embodiment of the Side View of a folded sofa to which the invention relates.
Figure 10:
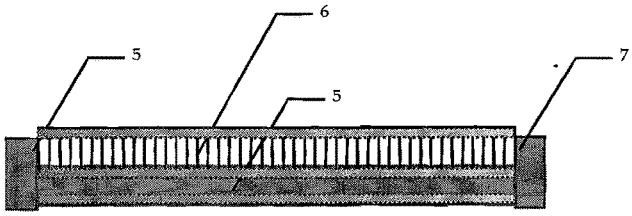
FIG. 10 shows a particular embodiment of the expanded front view of the foldable sofa to which the invention relates.

The invention claimed is:

1. A bed frame capable of being expanded and collapsed, comprising:

a honeycomb support structure configured as a plurality of hollow hexagons each with a length of 1 to 150 mm, said structure having a length and a width, each said hexagon formed of flexible material, at least one side of each hexagon glued to a side of an adjoining hexagon, said glue disposed along an outer side of said length of said hexagon at a distance of 1 to 50 mm, each said hexagon formed of flexible material layers, said honeycomb structure visible when in an expanded state; and a frame for housing said honeycomb structure, said frame comprising:

a headboard attached to a first end of the length of said honeycomb structure;

an end board attached to a second end of the length of said honeycomb structure, said headboard and end board separated by a distance of the length of said structure; and first and second side boards disposed on respective sides at a distance of the width of said honeycomb structure and extending between said headboard and said end board;

wherein the honeycomb structure is configured to be selectively expandable and contractible.

2. The bed frame of claim 1, wherein the honeycomb structure includes a first zone and a second zone non-overlapping with the first zone in top view, wherein each of the hollow cells in the first zone has a smaller size than a smallest hollow cell in the second zone in order to provide increased structural support against external stress applied to the first zone as compared to the second zone.

3. The bed frame of claim 1, wherein the hexagons of the honeycomb structure are formed of at least one of the items from the group consisting of cellulose material, paper, synthetic paper, non-woven fabric, and plastic material.

4. The bed frame of claim 1, wherein the hexagons are formed of paper, and at least one of the paper layers has a weight of about 40 grams to 500 grams per square meter.

5. The bed frame of claim 1, wherein the hexagons are formed of paper, and at least one of the paper layers has a thickness of about 10 μm to about 15 mm.

6. The bed frame of claim 1, wherein the hexagons are waterproof.

7. The bed frame of claim 1, wherein the hexagons are fire-retardant.

8. The bed frame of claim 1, wherein the material used for gluing includes at least one of the items from the group consisting of starch, PVA, resins, and acrylic material.

9. The bed frame of claim 1, wherein the material used for gluing includes starch.

10. The bed frame of claim 9, wherein the length of the disposed glue is limited to from about 2 cm to about 10 cm.

11. The bed frame of claim 1, wherein at least one of said headboard, end board, and side boards is formed from the group consisting of wood, steel, and aluminum.

12. The sofa of claim 1, wherein the hexagons are waterproof.

13. The bed frame of claim 1, wherein said glued sections are offset from one another.

14. A sofa capable of being expanded and collapsed, comprising:

a honeycomb support structure configured as a plurality of hollow hexagons each with a length of 1 to 150 mm, said structure having a length and a width, each said hexagon formed of flexible material, at least one side of each hexagon glued to a side of an adjoining hexagon, said glue disposed along an outer side of said length of said hexagon at a distance of 1 to 50 mm, each said hexagon formed of flexible material layers, said honeycomb structure visible when in an expanded state;

a frame comprising first and second extension rods and first and second side boards;

first and second armrests each connected to an end of the honeycomb structure and to said frame;

padding disposed over the honeycomb structure; and sponge material disposed over the padding;

wherein, when the honeycomb structure is in the expanded state, said first and second extension rods are respectively connected to connectors arranged along a length of said first and second side boards, the first and second extension rods being configured to maintain the honeycomb structure in the expanded state;

wherein the honeycomb structure is configured to be selectively expandable and contractible.

15. The sofa of claim 14, wherein the flexible material of the honeycomb structure is formed of at least one of the items from the group consisting of cellulose material, paper, synthetic paper, non-woven fabric, and plastic material.

16. The sofa of claim 14, wherein the first and second armrests are hollow, each defining a storage space therein.

17. The sofa of claim 14, wherein the first and second armrests are each formed including an expandable honeycomb structure that is covered by pieces of hard material formed of at least one of the items from the group consisting of MDF sheets and plywood.

18. The sofa of claim 14, wherein the flexible material paper is fire-retardant.

19. The sofa of claim 14, wherein the honeycomb structure includes a first zone and a second zone non-overlapping with the first zone in top view, wherein each of the hollow cells in the first zone has a smaller size than a smallest hollow cell in the second zone in order to provide increased structural support against external stress applied to the first zone as compared to the second zone.

20. A method of manufacturing a bed frame, the method comprising the steps of:

forming a selectively expandable and collapsible honeycomb structure by arranging a series of hexagonal frames, each said frame including sheets of paper, each said frame glued on a side pairwise with an adjoining frame, wherein the gluing operation consists of disposing glue only between select portions of pairs of paper sheets that face and contact one another, the selected glue portions being spaced apart from one another and collectively having a staggered formation;

cutting the glued sheets of paper to a size of the bed frame;

gluing a headboard to a first end of the glued sheets of paper;

gluing an end board to a second of the glued sheets of paper, first and second ends being opposite to one another;

expanding the honeycomb structure by distancing the first and second ends of the glued sheets of paper away from one another, the expanded honeycomb structure having a first side extending between the first and second ends of the glued sheets of paper and a second side extending between the first and second ends of the glued sheets of paper, the first and second sides of the expanded honeycomb structure being opposite to one another;

disposing a first side board on the first side of the honeycomb structure, the first side board extending between the headboard and the end board;

disposing a second side board on the second side of the honeycomb structure, the second side board extending between the headboard and the end board; and covering each of the first and second side boards with least one of the items from the group consisting of fabric, leather, and felt, wherein the headboard, the end board, the first side board, and the second side board are each formed of at least one of the items from the group consisting of wood, steel, and aluminum.

* * * * *